US009644626B2

(12) United States Patent
Akatsuka et al.

(10) Patent No.: US 9,644,626 B2
(45) Date of Patent: May 9, 2017

(54) VANE PUMP

(71) Applicant: KAYABA INDUSTRY CO., LTD., Tokyo (JP)

(72) Inventors: Koichiro Akatsuka, Gifu (JP); Tomoyuki Fujita, Gifu (JP); Fumiyasu Kato, Aichi (JP)

(73) Assignee: KYB Corporation, Tokyo (JP)

( * ) Notice: Subject to any disclaimer, the term of this patent is extended or adjusted under 35 U.S.C. 154(b) by 29 days.

(21) Appl. No.: 14/772,502

(22) PCT Filed: Feb. 27, 2014

(86) PCT No.: PCT/JP2014/054845
§ 371 (c)(1),
(2) Date: Sep. 3, 2015

(87) PCT Pub. No.: WO2014/136646
PCT Pub. Date: Sep. 12, 2014

(65) Prior Publication Data

US 2016/0003241 A1 Jan. 7, 2016

(30) Foreign Application Priority Data

Mar. 6, 2013 (JP) ..... 2013-044575

(51) Int. Cl.
*F01C 1/00* (2006.01)
*F04C 13/00* (2006.01)
(Continued)

(52) U.S. Cl.
CPC ..... *F04C 13/001* (2013.01); *F01C 21/108* (2013.01); *F04C 2/344* (2013.01); *F04C 2/3448* (2013.01); *F04C 15/06* (2013.01)

(58) Field of Classification Search
CPC ..... F01C 21/108; F04C 13/001; F04C 15/06; F04C 2/344; F04C 2/3448
See application file for complete search history.

(56) References Cited

U.S. PATENT DOCUMENTS

2007/0134120 A1* 6/2007 Fujita ..... F01C 21/108 418/112
2013/0280118 A1* 10/2013 Akatsuka ..... F01C 21/0863 418/191

(Continued)

FOREIGN PATENT DOCUMENTS

JP 2003-097453 A 4/2003
JP 2011-196359 A 10/2011
JP 2012007512 A * 1/2012

OTHER PUBLICATIONS

Translation JP2012007512A, Jan. 12, 2012.*

*Primary Examiner* — Jesse Bogue
(74) *Attorney, Agent, or Firm* — Rabin & Berdo, P.C.

(57) ABSTRACT

A vane pump includes: a rotor; vanes; a cam ring; pump chambers; a suction port; a discharge port; back-pressure chambers; a discharge-side back pressure port configured to guide working fluid that is discharged from the discharge port to the back-pressure chambers; and suction-side back pressure ports configured to guide the working fluid to the back-pressure chambers. The suction-side back pressure ports are formed to be divided into a low-pressure port and a high-pressure port, the low-pressure port being configured to guide the working fluid in the suction port to the back-pressure chambers, and the high-pressure port being configured to guide the working fluid that is discharged from the discharge port to the back-pressure chambers. The high-pressure port is arranged at the forward-side of the low-pressure port in rotating direction of the rotor.

2 Claims, 6 Drawing Sheets

(51) Int. Cl.

| | |
|---|---|
| ***F04C 2/344*** | (2006.01) |
| ***F01C 21/10*** | (2006.01) |
| ***F04C 15/06*** | (2006.01) |

(56) References Cited

U.S. PATENT DOCUMENTS

| | | | | |
|---|---|---|---|---|
| 2015/0030486 | A1* | 1/2015 | Fujita | F04C 2/344 418/23 |
| 2015/0056090 | A1* | 2/2015 | Akatsuka | F04C 2/344 418/29 |

* cited by examiner

VANE PUMP

TECHNICAL FIELD

The present invention relates to a vane pump that is used as a fluid pressure source in a fluid hydraulic apparatus.

BACKGROUND ART

A vane pump includes a rotor in which vanes are received, a cam ring that has an inner circumferential cam face with which tip portions of the vanes slidingly contact, and a side plate that slidingly contact with one end side of the rotor in the axial direction. The side plate is provided with a suction port and a discharge port, each of the suction port and the discharge port is formed in an arc shapes, the suction port guides working fluid into pump chambers defined by the rotor, the cam ring, and the adjacent vanes, and a discharge port guides the working fluid discharged from the pump chambers.

Furthermore, the side plate is provided with a back pressure port that guides the working fluid, which is discharged from the discharge port, to back-pressure chambers defined on the base-end sides of the vanes. With such a configuration, because the vanes are pressed radially outward by the pressure of the working fluid in the back-pressure chambers, tip ends of the vanes can slidingly contact with the inner circumference of the cam ring over the whole circumference of the rotor.

JP2003-97453A discloses a technique where each of a back pressure port at suction side and a back pressure port at discharge side is formed in an arc shape, both ends of the back pressure ports are communicated through orifice grooves, the back pressure port at the suction side is provided for introducing, to back-pressure chambers, working fluid discharged from a discharge port in a suction section in which the working fluid is guided to pump chambers, and the back pressure port at the discharge side is provided for introducing, to the back-pressure chambers, the working fluid discharged from the discharge port in a discharge section in which the working fluid is discharged from the pump chambers.

SUMMARY OF INVENTION

However, in the suction section, because the pressure in the pump chambers is low, the vanes are strongly pressed against the inner circumferential cam face of the cam ring by the pressure in the back-pressure chambers. With this, a sliding resistance between the tip ends of the vanes and the inner circumferential cam face is increased to increase rotating load of the rotor, and thereby, efficiency of the vane pump is deteriorated.

Thus, it is considered to block the communication between the back pressure port at the suction side and the back pressure port at the discharge side and to introduce the working fluid that flows through the suction port to the back pressure port at the suction side. With such a configuration, because the pressure in the back-pressure chambers in the suction section becomes low, the sliding resistance between the tip ends of the vanes and the inner circumferential cam face is reduced, and thereby, the deterioration of the efficiency of the vane pump is suppressed.

However, if the pressure in the back pressure port at the suction side is lowered as described above, because the pressure in the pump chambers and the pressure in the back-pressure chambers become substantially the same in the suction section, a force acting in the direction in which the vanes project in the suction section is solely the centrifugal force generated by the rotation of the rotor. Therefore, because the pressing force for the vanes is insufficient when the vanes move to the discharge section, there is a risk that the vanes are separated from the inner circumferential cam face, making the pump chamber in the discharge section to communicate with the pump chamber in the suction section, and causing the pump discharge pressure to drop.

The present invention aims to provide a vane pump that is capable of preventing separation of vanes when moving to a discharge section while suppressing a sliding resistance of the vanes in a suction section.

According to one aspect of the present invention, a vane pump that is used as a fluid pressure source includes: a rotor configured to be rotationally driven; a plurality of slits formed in a radiating pattern so as to open to an outer circumference of the rotor; vanes slidably received in the respective slits; a cam ring that has an inner circumferential cam face with which tip portions of the vanes slidingly contact, the tip portions being end portions of the vanes in direction projecting from the slits; pump chambers defined by the rotor, the cam ring, and the adjacent vanes; a suction port configured to guide working fluid that is to be sucked to the pump chambers; a discharge port configured to guide the working fluid that is discharged from the pump chambers; back-pressure chambers formed in the slits, the back-pressure chambers being partitioned by base-end portions of the vanes, the base-end portions being end portions at the opposite side from the tip portions; a discharge-side back pressure port configured to guide the working fluid that is discharged from the discharge port to the back-pressure chambers in a discharge section in which the pump chambers are in communication with the discharge port; and suction-side back pressure ports configured to guide the working fluid to the back-pressure chambers in a suction section in which the pump chambers are in communication with the suction port. The suction-side back pressure ports are formed to be divided into a low-pressure port and a high-pressure port, the low-pressure port being configured to guide the working fluid in the suction port to the back-pressure chambers, the high-pressure port being configured to guide the working fluid that is discharged from the discharge port to the back-pressure chambers, and the high-pressure port is arranged at the forward-side of the low-pressure port in rotating direction of the rotor.

DESCRIPTION OF EMBODIMENTS

With reference to the drawings, an embodiment of the present invention will be described below.

Figure 1:
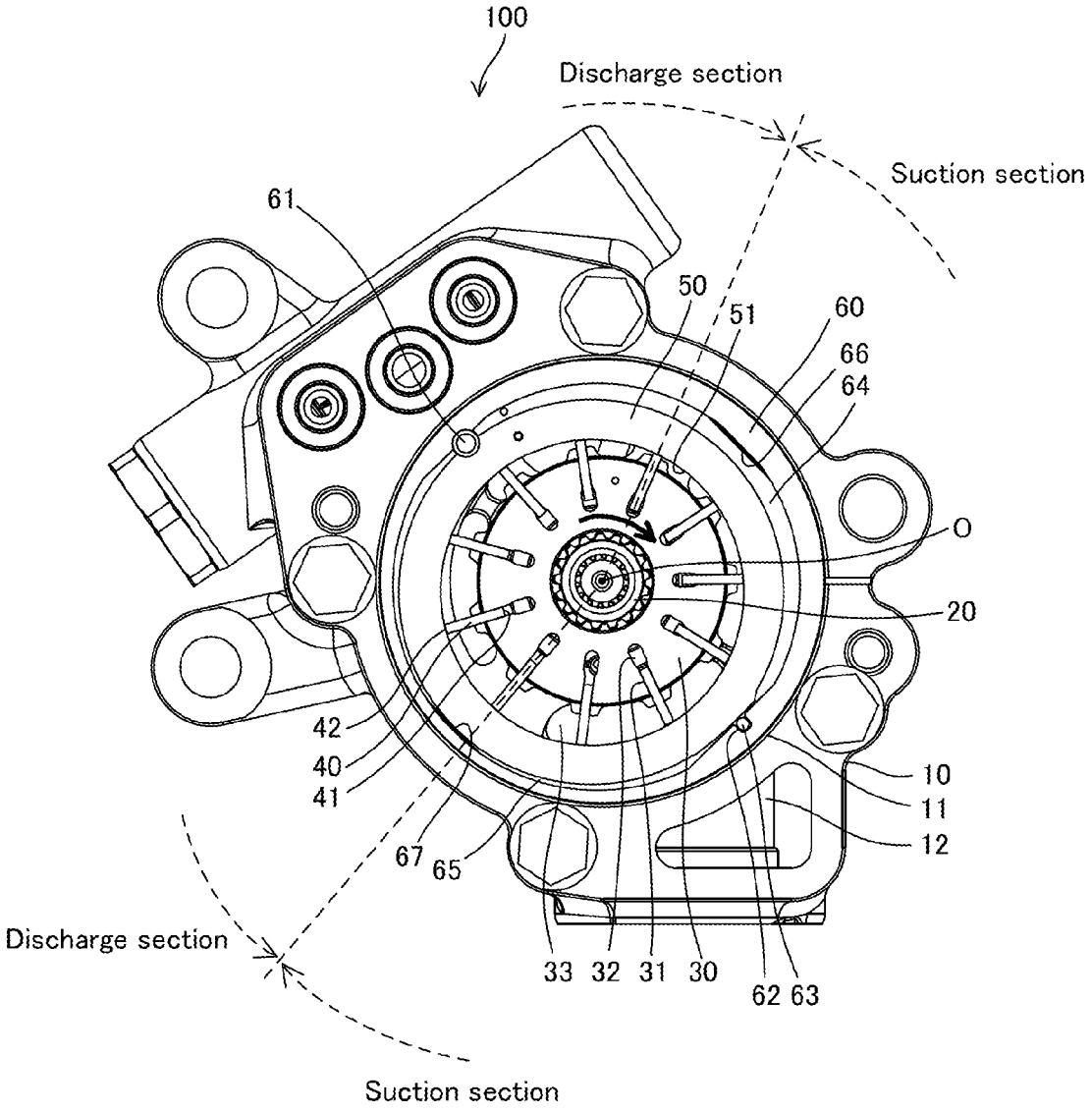
FIG. 1 is a front view showing a vane pump according to an embodiment of the present invention.
Figure 2:
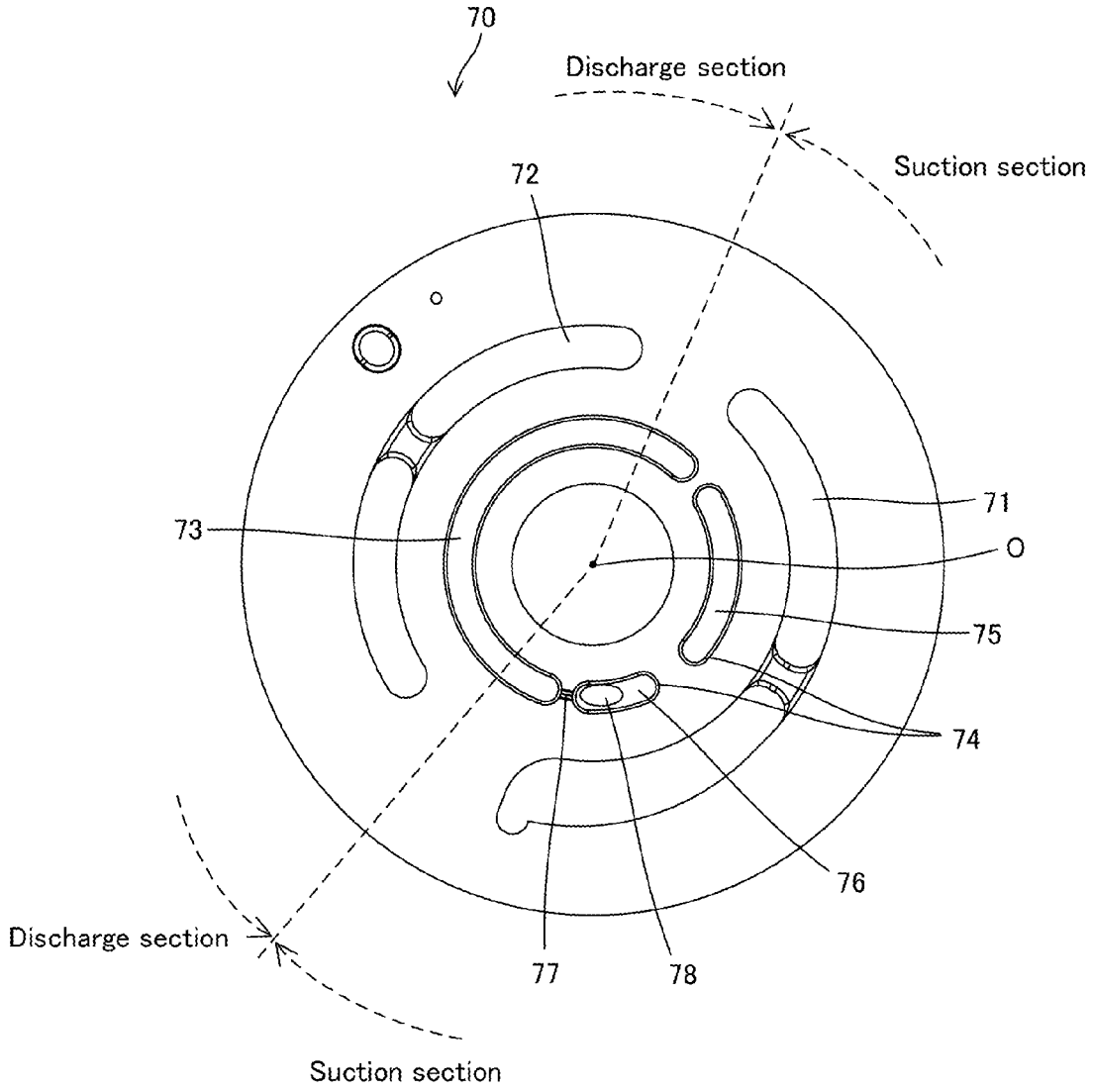
FIG. 2 is a front view of a side plate.
Figure 3:
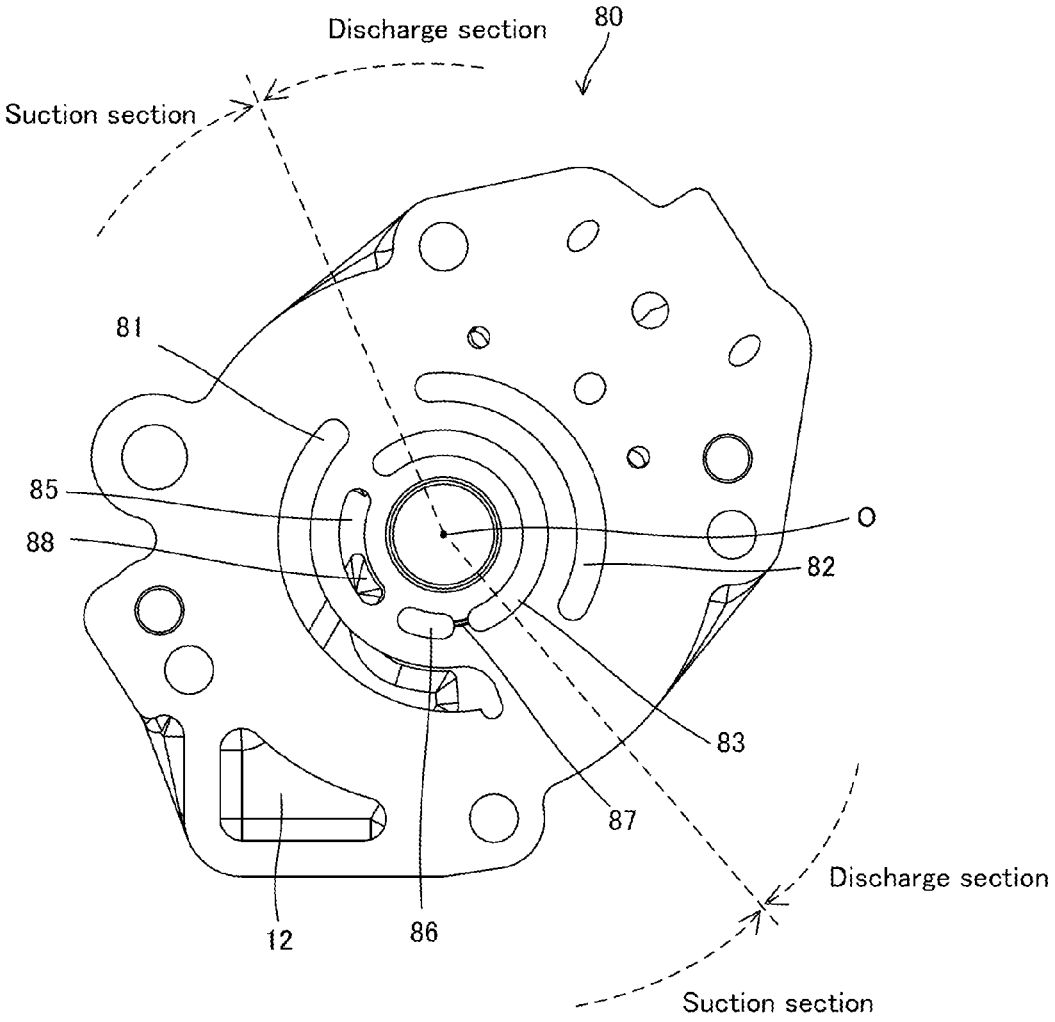
FIG. 3 is a front view of a pump cover.

FIG. 1 is a front view of a vane pump 100 according to this embodiment, and is a diagram viewed from a direction along a drive shaft 20 in a state in which a pump cover 80 has been detached. FIG. 2 is a front view of a side plate 70 and is a diagram viewed from the same direction as that in FIG. 1. FIG. 3 is a front view of the pump cover 80 and is a diagram showing a state in which the pump cover 80 that has been detached from the vane pump 100 shown in FIG. 1 is turned over about the axis along the up and down direction on the plane of figure.

The vane pump 100 is a variable displacement vane pump, and is used as a fluid pressure source for a fluid hydraulic apparatus, such as, a power steering apparatus, a continuously variable transmission, or the like, mounted on a vehicle. Oil, aqueous alternative fluid of other type, or the like may be used as working fluid. Although a variable displacement vane pump is illustrated in this embodiment, the vane pump may be of fixed displacement type.

The vane pump 100 is driven by an engine (not shown) etc., for example, and generates fluid pressure as a rotor 30 that is linked to the drive shaft 20 is rotated clockwise as shown by an arrow in FIG. 1.

The vane pump 100 includes a pump body 10, the drive shaft 20 that is rotatably supported by the pump body 10, the rotor 30 that is rotationally driven by being linked to the drive shaft 20, a plurality of vanes 40 that are provided so as to be capable of reciprocating in the radial direction relative to the rotor 30, a cam ring 50 that accommodates the rotor 30 and the vanes 40, and an annular adapter ring 60 that surrounds the cam ring 50.

In the rotor 30, a plurality of slits 31 having openings on the outer circumferential surface of the rotor 30 are formed in a radiating pattern with predetermined gaps therebetween. The vanes 40 are inserted into the respective slits 31 in a freely slidable manner. At the base-end sides of the slits 31, back-pressure chambers 32 are formed by being defined by base-end portions 41 of the vanes 40, which are end portions at the opposite side from the direction in which the vanes 40 project from the slits 31, and the working fluid is guided to the back-pressure chambers 32. The vanes 40 are pressed in the direction in which the vanes 40 project from the slits 31 by the pressure of the back-pressure chambers 32.

In the pump body 10, a pump accommodating concaved portion 11 that accommodates the adapter ring 60 is formed. The side plate 70 (see FIG. 2) is arranged on a bottom surface of the pump accommodating concaved portion 11 so as to abut against the one side in the axial direction (back side in FIG. 1) of each of the rotor 30, the cam ring 50, and the adapter ring 60. An opening of the pump accommodating concaved portion 11 is closed with the pump cover 80 (see FIG. 3) that abuts against the other side (front side in FIG. 1) of each of the rotor 30, the cam ring 50, and the adapter ring 60. The pump cover 80 and the side plate 70 are arranged in a state in which both side surfaces of each of the rotor 30, the cam ring 50, and the adapter ring 60 are sandwiched. Pump chambers 33 are defined between the rotor 30 and the cam ring 50 by being partitioned by the respective vanes 40.

As shown in FIG. 2, on the side plate 70, a suction port 71 for guiding the working fluid into the pump chambers 33 and a discharge port 72 for discharging the working fluid in the pump chambers 33 and guiding it to the fluid hydraulic apparatus are formed. The suction port 71 and the discharge port 72 are individually formed so as to have arc shapes centered at a center O of the drive shaft 20.

As shown in FIG. 3, a suction port 81 and a discharge port 82 are formed on the pump cover 80 at respective positions symmetrical to those on the side plate 70. In other words, the suction port 81 on the pump cover 80 is in communication with the suction port 71 on the side plate 70 through the pump chambers 33, and the discharge port 82 on the pump cover 80 is in communication with the discharge port 72 on the side plate 70 through the pump chambers 33.

Referring back to FIG. 1, the cam ring 50 is an annular member, and has an inner circumferential cam face 51 with which tip portions 42 of the vanes 40, which are end portions of the vanes 40 in the direction projecting from the slits 31, slidingly contact. On the inner circumferential cam face 51, a suction section in which the working fluid is sucked through the suction ports 71 and 81 by the rotation of the rotor 30 and a discharge section in which the working fluid is discharged through the discharge ports 72 and 82.

The suction ports 71 and 81 are formed so as to penetrate the side plate 70 and to communicate with a tank (not shown) through a suction passage 12 formed on the pump body 10 and the pump cover 80, and the working fluid in the tank is supplied to the pump chambers 33 from the suction ports 71 and 81 on the side plate 70 and the pump cover 80, respectively, through the suction passage 12.

The discharge port 72 is formed so as to penetrate the side plate 70 and to communicate with a high-pressure chamber (not shown) formed on the pump body 10. The high-pressure chamber is in communication with the fluid hydraulic apparatus (not shown) outside the vane pump 100 through a discharge passage (not shown). In other words, the working fluid that is discharged from the pump chambers 33 is supplied to the fluid hydraulic apparatus through the discharge ports 72 and 82, the high-pressure chamber, and the discharge passage.

The adapter ring 60 is accommodated in the pump accommodating concaved portion 11 of the pump body 10. A support pin 61 is interposed between the adapter ring 60 and the cam ring 50. The cam ring 50 is supported by the support pin 61 such that the cam ring 50 swings about the support pin 61 inside the adapter ring 60, and thereby, is made eccentric to the center O of the drive shaft 20.

A seal member 63 is interposed in a groove 62 of the adapter ring 60, and the seal member 63 slidingly contacts with the outer circumferential surface of the cam ring 50 during the swing of the cam ring 50. A first fluid pressure chamber 64 and a second fluid pressure chamber 65 are partitioned by the support pin 61 and the seal member 63 in a space between the outer circumferential surface of the cam ring 50 and the inner circumferential surface of the adapter ring 60.

The cam ring 50 swings about the support pin 61 by a pressure difference between the first fluid pressure chamber 64 and the second fluid pressure chamber 65. As the cam ring 50 swings, the amount of eccentricity of the cam ring 50 with respect to the rotor 30 is changed, and the discharge capacity of the pump chambers 33 is changed. When the cam ring 50 swings counterclockwise about the support pin 61 in FIG. 1, the amount of eccentricity of the cam ring 50 with respect to the rotor 30 is reduced, and thus, the discharge capacity of the pump chambers 33 is reduced. In contrast, as shown in FIG. 1, when the cam ring 50 swings clockwise about the support pin 61, the amount of eccentricity of the cam ring 50 with respect to the rotor 30 is increased, and thus, the discharge capacity of the pump chambers 33 is increased.

A restricting portion 66 that restricts movement of the cam ring 50 in the direction in which the amount of eccentricity with respect to the rotor 30 is reduced and a restricting portion 67 that restricts movement of the cam ring 50 in the direction in which the amount of eccentricity with respect to the rotor 30 is increased are respectively formed on the inner circumferential surface of the adapter ring 60 in a swelled manner. In other words, the restricting portion 66 defines the minimum amount of eccentricity of the cam ring 50 with respect to the rotor 30, and the restricting portion 67 defines the maximum amount of eccentricity of the cam ring 50 with respect to the rotor 30.

The pressure difference between the first fluid pressure chamber 64 and the second fluid pressure chamber 65 is controlled by a control valve (not shown). The control valve controls the working fluid pressure in the first fluid pressure chamber 64 and the second fluid pressure chamber 65 such that the amount of eccentricity of the cam ring 50 with respect to the rotor 30 is reduced with the increase in the rotation speed of the rotor 30.

Back pressure ports for guiding the working fluid to the back-pressure chambers 32 will be described below.

As shown in FIG. 2, a discharge-side back pressure port 73 that is in communication with the back-pressure chambers 32 in the discharge section and suction-side back pressure ports 74 that are in communication with the back-pressure chambers 32 in the suction section are formed on the side plate 70.

The discharge-side back pressure port 73 is formed so as to have an arc shape centered at the center O of the drive shaft 20 over the whole region of the discharge section. The suction-side back pressure ports 74 include a low-pressure port 75 that is provided at the rearward-side in the rotating direction of the rotor 30 in the suction section, and a high-pressure port 76 that is provided at the forward-side in the rotating direction of the rotor 30 in the suction section. In other words, the back-pressure chambers 32 are made to communicate with the discharge-side back pressure port 73, the low-pressure port 75, and the high-pressure port 76 in this order by the rotation of the rotor 30.

The low-pressure port 75 and the high-pressure port 76 are provided in a separated manner so as not to communicate with each other. On the other hand, the discharge-side back pressure port 73 and the high-pressure port 76 are in communication through a narrow groove 77 having the cross-sectional area smaller than that of the high-pressure port 76. Furthermore, the high-pressure port 76 is in communication with the high-pressure chamber through a through hole 78 penetrating the side plate 70.

As shown in FIG. 3, a discharge-side back pressure port 83, a low-pressure port 85, and a high-pressure port 86 are formed on the pump cover 80 at respective positions symmetrical to those on the side plate 70. The discharge-side back pressure port 83 and the high-pressure port 86 are in communication through a narrow groove 87 as with the side plate 70. Furthermore, the low-pressure port 85 is in communication with the suction passage 12 through a through hole 88.

In the above-described configuration, the pressure of the working fluid that is discharged from the pump chambers 33 is guided to the discharge ports 72 and 82, the high-pressure chamber, the through hole 78, and the high-pressure ports 76 and 86, and then, guided to the discharge-side back pressure ports 73 and 83 through the narrow grooves 77 and 87. The pressure of the working fluid in the high-pressure ports 76 and 86 and the discharge-side back pressure ports 73 and 83 is guided to the back-pressure chambers 32 just before the suction section ends and in the discharge section, and the pressure of the working fluid in the back-pressure chambers 32 presses the vanes 40 in the direction in which the vanes 40 project towards the cam ring 50 from the rotor 30.

On the other hand, the working fluid in the suction passage 12 is guided to the low-pressure ports 75 and 85 through the through hole 88 that is provided in the low-pressure port 85 of the pump cover 80. The working fluid in the low-pressure ports 75 and 85 is guided to the back-pressure chambers 32 in the suction section.

When the vane pump 100 is operated, the vanes 40 are biased in the direction in which the vanes 40 project from the slits 31 by a biasing force by the pressure of the working fluid in the back-pressure chambers 32 that presses the base-end portions 41 of the vanes 40 and by the centrifugal force that is caused by the rotation of the rotor 30, and thereby, the tip portions 42 of the vanes 40 slidingly contact with the inner circumferential cam face 51 of the cam ring 50.

In the suction section, the vanes 40 that slidingly contact with the inner circumferential cam face 51 are projected from the rotor 30, thereby causing the pump chambers 33 to expand, and the working fluid is sucked into the pump chambers 33 from the suction ports 71 and 81. In the discharge section, the vanes 40 that slidingly contact with the inner circumferential cam face 51 are pushed back into the rotor 30, thereby causing the pump chambers 33 to contract, and the working fluid that is pressurized in the pump chambers 33 is discharged from the discharge ports 72 and 82.

A vane pump 200 according to a comparative example will be described below.

Figure 4:
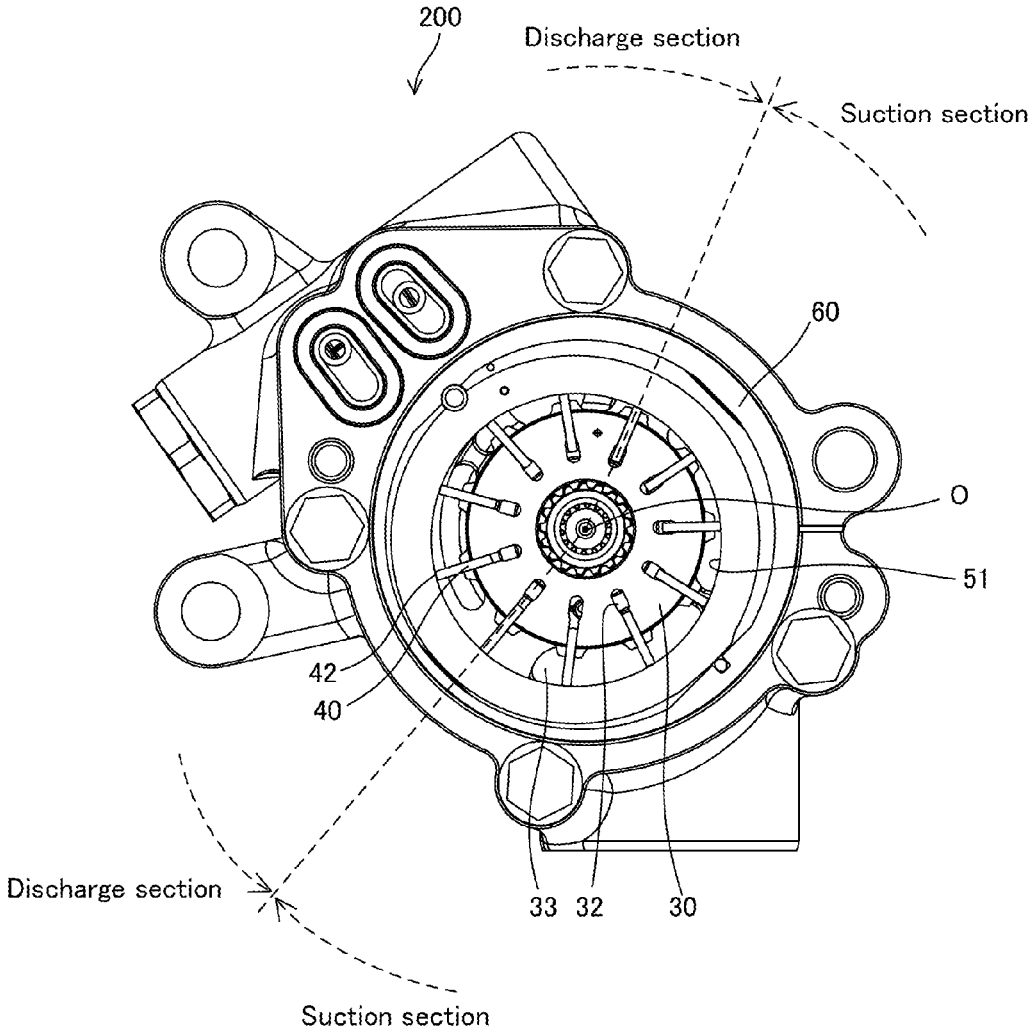
FIG. 4 is a front view showing a vane pump according to a comparative example.
Figure 5:
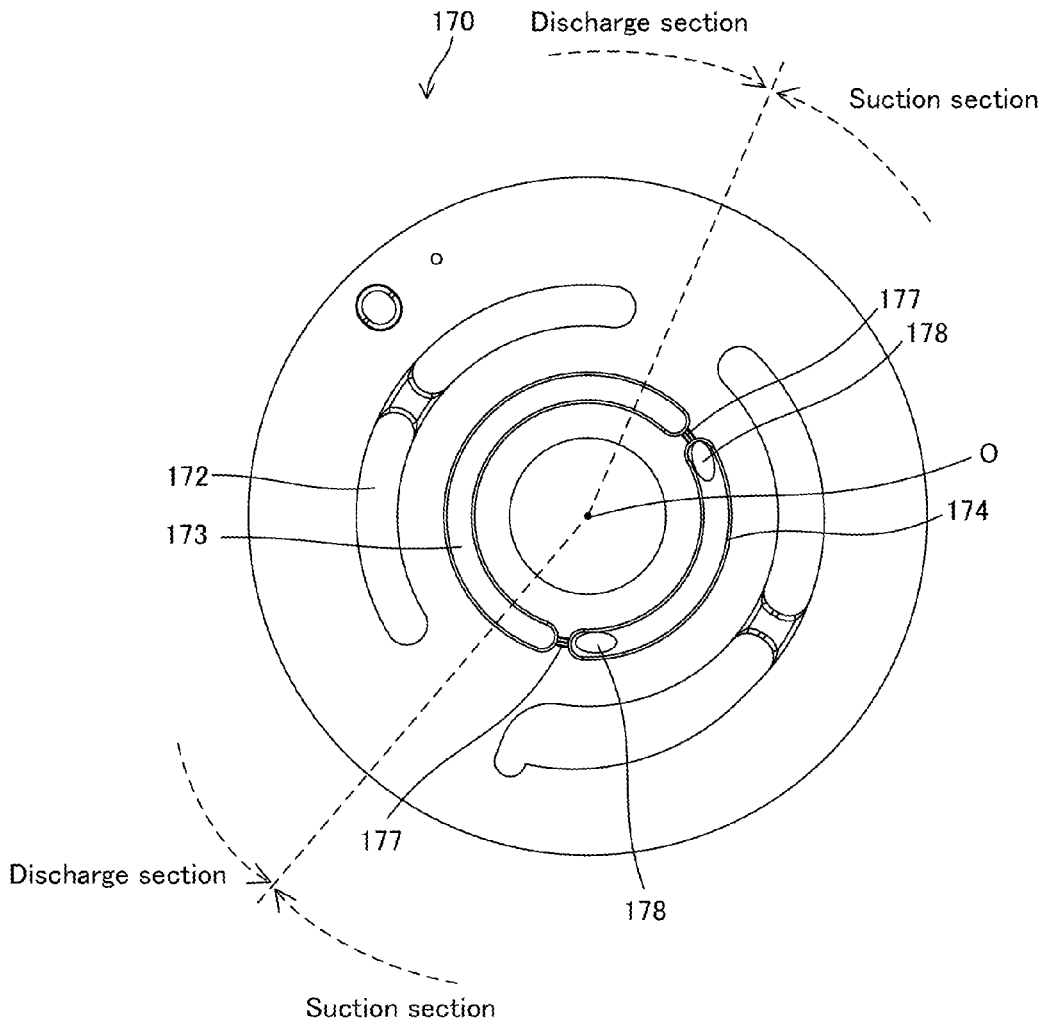
FIG. 5 is a front view of a side plate according to the comparative example.
Figure 6:
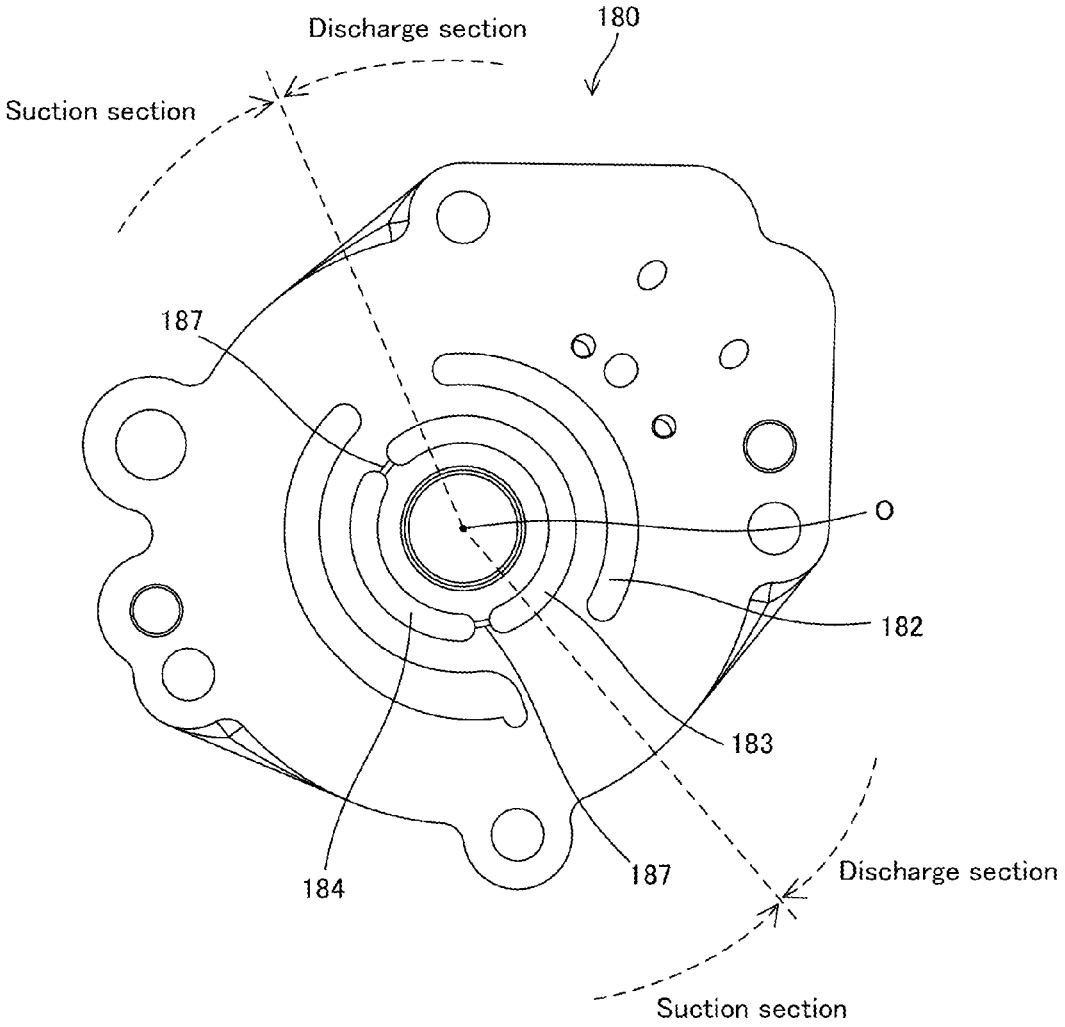
FIG. 6 is a front view of a pump cover according to the comparative example.

FIG. 4 is a front view of the vane pump 200 according to the comparative example, and is a diagram viewed from the direction along the drive shaft 20 in a state in which a pump cover 180 has been removed. FIG. 5 is a front view of a side plate 170 according to the comparative example. FIG. 6 is a front view of the pump cover 180 according to the comparative example.

With the vane pump 200 according to the comparative example, suction-side back pressure ports 174 and 184 are not divided into a low-pressure port and a high-pressure port. In other words, the suction-side back pressure ports 174 and 184 are formed so as to have arc shapes centered at the center O of the drive shaft 20 over the whole region of the suction section.

Furthermore, the suction-side back pressure ports 174 and 184 and discharge-side back pressure ports 173 and 183 are in communication through narrow grooves 177 and 187. The suction-side back pressure port 174 is in communication with the high-pressure chamber through some through holes 178 provided at both ends of the suction-side back pressure port 174 so as to penetrate the side plate 170.

With such a configuration, the pressure of the working fluid that is discharged from the pump chambers 33 is introduced to discharge ports 172 and 182, the high-pressure chamber, the through holes 178, the suction-side back pressure ports 174 and 184, and then, introduced to the discharge-side back pressure ports 173 and 183 through the narrow grooves 177 and 187. Therefore, the suction-side back pressure ports 174 and 184 and the discharge-side back pressure ports 173 and 183 are both filled with the high-pressure working fluid that is discharged from the pump chambers 33.

In the suction section, because the pressure in the pump chambers 33 is low, the vanes 40 are strongly pressed against the inner circumferential cam face 51 of the cam ring 50 due to the pressure of the high-pressure working fluid in the back-pressure chambers 32. With this, there is a risk that the efficiency of the vane pump 200 is deteriorated due to the increase in the sliding resistance between the tip portions 42 of the vanes and the inner circumferential cam face 51, which in turn increases the rotating load of the rotor 30.

In addition, it is considered to suppress the above-described sliding resistance by blocking the communication between the suction-side back pressure ports 174 and 184 and the discharge-side back pressure ports 173 and 183, and by introducing the working fluid in a suction passage into the suction-side back pressure ports 174 and 184.

However, if the pressure in the suction-side back pressure ports 174 and 184 is decreased as described above, because the pressure in the pump chambers 33 and the pressure in the back-pressure chambers 32 become substantially the same in the suction section, a force acting in the direction in which the vanes 40 project in the suction section is solely the centrifugal force generated by the rotation of the rotor 30. Therefore, the pressing force for the vanes 40 is insufficient when the vanes 40 move to the discharge section, and there is a risk that the pump chamber 33 in the discharge section and the pump chamber 33 in the suction section are made to communicate through a gap formed between the vane 40 and the inner circumferential cam face 51, causing the discharge pressure of the vane pump 200 to drop.

Thus, as shown in FIGS. 2 and 3, this embodiment is configured such that the suction-side back pressure ports 74 are divided into the low-pressure port 75 and the high-pressure port 76, the high-pressure working fluid in the high-pressure chamber is guided to the high-pressure port 76, and the low-pressure working fluid in the suction passage 12 is guided to the low-pressure port 75.

With such a configuration, along the rotating direction of the rotor 30 in the first half region of the suction section, the back-pressure chambers 32 are made to communicate with the low-pressure port 75, causing the pressing force for the vanes 40 to drop. Therefore, because the sliding resistance between the vanes 40 and the cam ring 50 is reduced, the efficiency of the vane pump 100 is increased.

In addition, in the region just before ending the suction section, because the back-pressure chambers 32 are made to communicate with the high-pressure port 76, the high-pressure working fluid is introduced from the high-pressure chamber to the back-pressure chambers 32, and the vanes 40 can reliably be pressed against the inner circumferential cam face 51 before moving into the discharge section. Therefore, the boundary between the suction section and the discharge section can reliably be defined with the vanes 40, and drop in the discharge pressure of the vane pump 100 can reliably be suppressed.

According to the embodiment mentioned above, the advantages described below are afforded.

The suction-side back pressure ports 74 are formed so as to be divided into the low-pressure port 75 and the high-pressure port 76, and the high-pressure port 76 is arranged at the forward-side of the low-pressure port 75 in the rotating direction of the rotor 30. In addition, the working fluid in the suction passage 12 is guided to the low-pressure port 75, and the high-pressure working fluid in the high-pressure chamber is guided to the high-pressure port 76.

With such a configuration, while the back-pressure chambers 32 are in communication with the low-pressure port 75 in the suction section, because the pressure in the back-pressure chambers 32 becomes low to reduce the pressing force for the vanes 40, the sliding resistance between the vanes 40 and the inner circumferential cam face 51 is suppressed, and the efficiency of the vane pump 100 can be improved.

In addition, because protruding level of the vanes 40 reduces in the suction section, it is possible to suppress interference to a flow channel of the working fluid that is to be sucked into the pump chambers 33 from the suction ports 71 and 81 when the vanes 40 pass through the suction section. Thus, a sucking efficiency of the working fluid can be improved.

Furthermore, when the back-pressure chambers 32 are made to communicate with the high-pressure port 76 in the suction section, because the pressure in the back-pressure chambers 32 becomes high to increase the pressing force for the vanes 40, the vanes can be caused to slidingly contact reliably with the inner circumferential cam face 51 before moving into the discharge section. Thus, the boundary between the suction section and the discharge section can reliably be defined with the vanes 40 that slidingly contact with the inner circumferential cam face 51, and the drop of the discharge pressure of the vane pump 100 can be prevented.

In particular, even when the pump is started at low temperature at which the working fluid is more viscous, because the vanes 40 that are settled in the slits 31 can be made projected quickly to slidingly contact with the inner circumferential cam face 51, the discharge pressure of the vane pump 100 is increased promptly, and a startability of the vane pump 100 can be improved.

Furthermore, because the discharge-side back pressure port 73 is made to communicate with the high-pressure port 76 through the narrow groove 77 having the cross-sectional area smaller than that of the high-pressure port 76, the tip portions 42 of the vanes 40 are pushed by the inner circumferential cam face 51 such that the vanes 40 are pushed into the slits 31 in the discharge section, and the resulting volume reduction of the back-pressure chambers 32 causes the working fluid flowing into the discharge-side back pressure port 73 to communicate with the high-pressure port 76 as a narrowed flow through the narrow groove 77. Therefore, because the pressure in the discharge-side back pressure port 73 is held at higher level than that in the high-pressure port 76 by the amount of the pressure loss at the narrow groove 77, the force for projecting the vanes 40 can be maintained at the high level in the discharge section, and the slidingly contacted state between the vanes 40 and the inner circumferential cam face 51 can reliably be maintained.

Embodiments of this invention were described above, but the above embodiments are merely examples of applications of this invention, and the technical scope of this invention is not limited to the specific constitutions of the above embodiments.

For example, in the above-mentioned embodiment, although the discharge-side back pressure port 73 and the suction-side back pressure ports 74 are individually provided on the side plate 70 and the pump cover 80, the discharge-side back pressure port 73 and the suction-side back pressure ports 74 may be provided on only one of the side plate 70 and the pump cover 80. In a case in which the discharge-side back pressure port 73 and the suction-side back pressure ports 74 are provided on the side plate 70 only, a new through hole may be provided such that the low-pressure port 75 of the side plate 70 is made to communicate with the suction passage 12. In a case in which the discharge-side back pressure port 73 and the suction-side back pressure ports 74 are provided on the pump cover 80 only, a new through hole may be provided such that the high-pressure port 86 of the pump cover 80 is made to communicate with the high-pressure chamber.

This application claims priority based on Japanese Patent Application No. 2013-044575 filed with the Japan Patent Office on Mar. 6, 2013, the entire contents of which are incorporated into this specification.

The invention claimed is:

1. A vane pump that is used as a fluid pressure source, comprising:

a rotor configured to be rotationally driven in a direction;

a plurality of slits formed in a radiating pattern so as to open to an outer circumference of the rotor;

vanes slidably received in the respective slits;

a cam ring that has an inner circumferential cam face with which tip portions of the vanes slidingly contact, the tip portions being end portions of the vanes in direction projecting from the slits;

pump chambers defined by the rotor, the cam ring, and the adjacent vanes;

a suction port configured to guide working fluid that is to be sucked to the pump chambers;

a discharge port configured to guide the working fluid that is discharged from the pump chambers;

back-pressure chambers formed in the slits, the back-pressure chambers being partitioned by base-end portions of the vanes, the base-end portions being end portions at the opposite side from the tip portions;

a discharge-side back pressure port configured to guide the working fluid that is discharged from the discharge port to the back-pressure chambers in a discharge section in which the pump chambers are in communication with the discharge port; and suction-side back pressure ports configured to guide the working fluid to the back-pressure chambers in a suction section in which the pump chambers are in communication with the suction port; wherein the suction-side back pressure ports are formed to be divided into a low-pressure port and a high-pressure port, the low-pressure port being configured to guide the working fluid in the suction port to the back-pressure chambers, and the high-pressure port being configured to guide the working fluid that is discharged from the discharge port to the back-pressure chambers, and the high-pressure port is arranged at the forward-side of the low-pressure port in the rotating direction of the rotor and is in communication with the discharge-side back pressure port through a narrow groove having a smaller cross-sectional area than that of the high-pressure port.

2. The vane pump according to claim 1, further comprising:

a side plate provided on one end side in an axial direction of the rotor, the side plate abutting against the rotor and the cam ring; and a pump cover provided on other end side in the axial direction of the rotor, the pump cover abutting against the rotor and the cam ring; wherein the discharge-side back pressure port and the suction-side back pressure ports are provided on at least one of the side plate and the pump cover.

* * * * *